US007798673B2

(12) United States Patent
Yang

(10) Patent No.: US 7,798,673 B2
(45) Date of Patent: Sep. 21, 2010

(54) AQUA-LAMP-BASED CANDLE-LIKE LIGHTING DEVICE

(76) Inventor: Chin-Sheng Yang, 4F., No. 26, Lane 358, Yung-An St., Tainan City (TW)

( * ) Notice: Subject to any disclaimer, the term of this patent is extended or adjusted under 35 U.S.C. 154(b) by 0 days.

(21) Appl. No.: 12/241,074

(22) Filed: Sep. 30, 2008

(65) Prior Publication Data

US 2009/0135585 A1 May 28, 2009

(30) Foreign Application Priority Data

Nov. 22, 2007 (TW) ..... 96219758 U

(51) Int. Cl.
*F21S 4/00* (2006.01)

(52) U.S. Cl. ..... 362/249.16; 362/96; 362/101; 362/318

(58) Field of Classification Search ..... 362/96, 362/101, 249.16
See application file for complete search history.

(56) References Cited

U.S. PATENT DOCUMENTS 3,964,194 A * 6/1976 Gugeler ..... 40/406
2006/0034100 A1* 2/2006 Schnuckle et al. ..... 362/810
2006/0215397 A1* 9/2006 Lee ..... 362/161
2007/0206372 A1* 9/2007 Casillas ..... 362/101

* cited by examiner

*Primary Examiner*—Sandra L O'Shea
*Assistant Examiner*—Jessica L McMillan
(74) *Attorney, Agent, or Firm*—Leong C. Lei

(57) ABSTRACT

An aqua-lamp-based candle-like lighting device includes a stand accommodating therein an incandescent lamp assembly that is engageable with a power source to generate heat. The stand has an open end in which an aqua-lamp base that defines an internal chamber is mounted. An illuminator for lighting purposes is arranged at an opening of the chamber. Thus, the heat generated by the incandescent lamp assembly is employed to cause a liquid contained in the aqua lamp base to flow and show a shining effect; and the illuminator of the internal chamber serves as a twinkling night lamp. As such, the aqua-lamp-based candle-like lighting device shows dual interests of visual effects in both light twinkling and liquid flowing.

2 Claims, 3 Drawing Sheets

AQUA-LAMP-BASED CANDLE-LIKE LIGHTING DEVICE

TECHNICAL FIELD OF THE INVENTION

The present invention generally relates to an aqua-lamp-based candle-like lighting device, and particularly to an aqua-lamp-based candle-like lighting device that features dual interests of visually watching twinkling light and flowing liquid, which are realized by means of an incandescent lamp assembly and an illuminator that are respectively accommodated in a stand and an aqua lamp.

DESCRIPTION OF THE PRIOR ART

Lighting devices are commonly used for general household lighting and besides such lighting devices, other lighting tools, such as table lamp and socket-plugged miniature candle-like lighting units, which are measures used to light a limited area around the lighting unit and to provide decoration for enhanced romantic atmosphere. Various of candle-like lighting device or other lighting devices for similar purposes are available in the market and they are of versatile designs, often depending upon the material used. A light source contained in such lighting devices can be a standard lamp bulb or light-emitting diode, or even a power-saving bulb/tube. Yet, all these variations are limited to the lighting and decoration related fields, and as such, the development of the candle-like lighting is subjected to limitation, making them no match to large-sized lighting devices that are of various designs subjected to substantially no limitation. A solution to overcome such a drawback is to combine interesting functions, other than simply lighting and decoration, to the candle-like lighting to make a breakthrough of the existing outside visual effect, by which attraction to the general consumers can be improved.

Based on years' experience in development and manufacturing of pendant lighting and a strong love for aqua lamp, the present applicant wishes to provide an aqua-lamp-based candle-like lighting device that, besides lighting in the nighttime, provides an additional censing or perfuming effect. With successive attempts in the development of such a device, an aqua-lamp-based candle-like lighting device is invented and will be further described hereinafter.

SUMMARY OF THE INVENTION

Thus, the present invention provides an aqua-lamp-based candle-like lighting device comprising a stand accommodating therein an incandescent lamp assembly that is engageable with a power source to generate heat. The stand has an open end in which an aqua-lamp base that defines an internal chamber is mounted. An illuminator for lighting purposes is arranged at an opening of the chamber. Thus, the heat generated by the incandescent lamp assembly is employed to cause a liquid contained in the aqua lamp base to flow and show a shining effect; and the illuminator of the internal chamber serves as a twinkling night lamp. As such, the aqua-lamp-based candle-like lighting device shows dual interests of visual effects in both light twinkling and liquid flowing.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
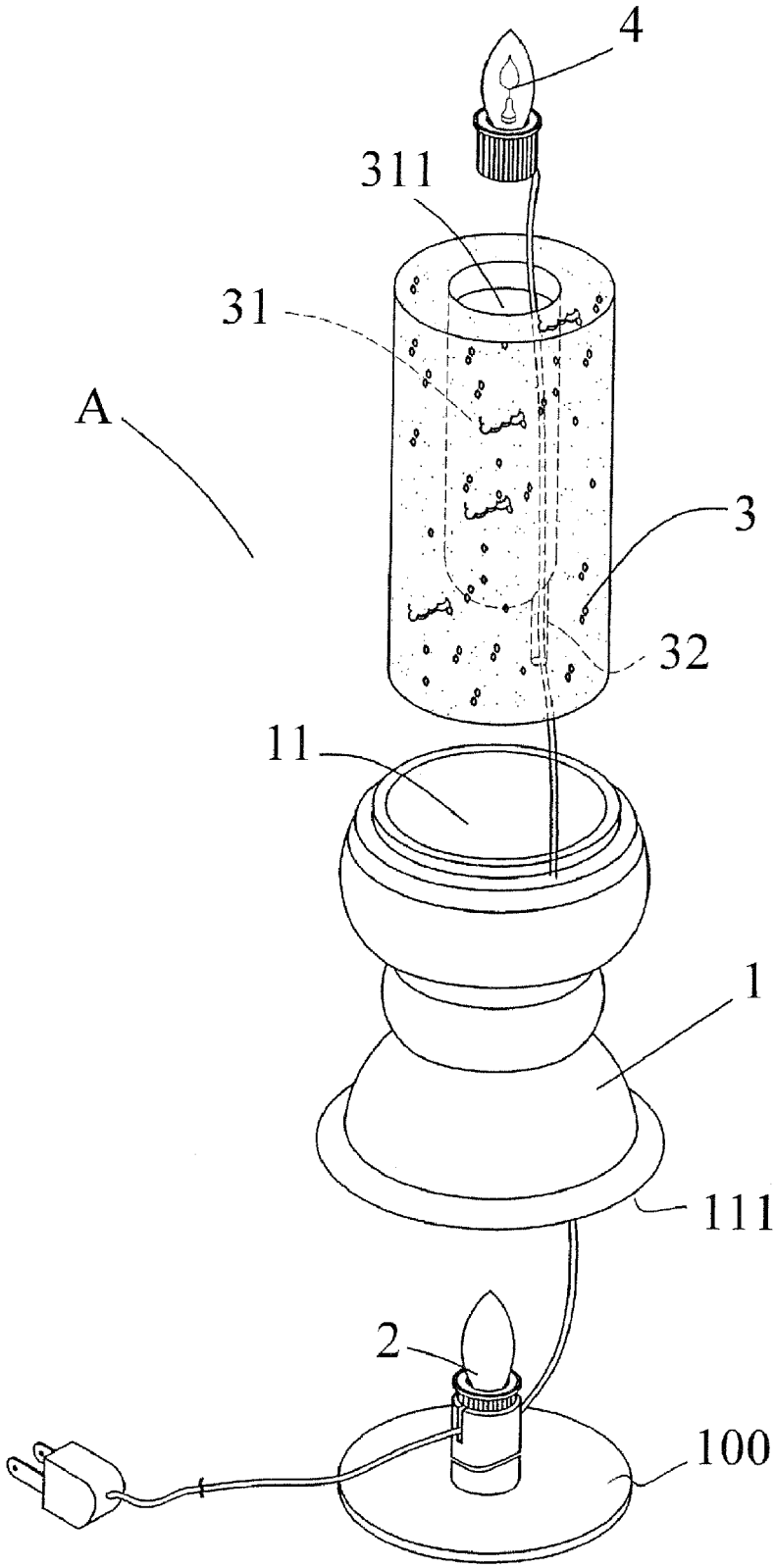
FIG. 1 is an exploded view of an aqua-lamp-based candle-like lighting device in accordance with the present invention.

With initial reference to FIG. 1, which illustrates an exploded view of an aqua-lamp-based candle-like lighting device constructed in accordance with the present invention, the aqua-lamp-based candle-like lighting device A generally comprises the following constituent parts/components:

A stand 1 comprises a hollow structure forming an open top 11 and an open bottom 111.

An incandescent lamp assembly 2 comprises a lighting element mounted on a bottom cover 100 engaged with the open bottom 111 of the stand 1, corresponding to the open end 11 of the stand 1, and electrically engageable a power source to generate light and heat.

A light-transmittable aqua-lamp base 3 comprises a three-dimensional and light-transmittable structure forming centrally an internal chamber 31 that is circumferentially surrounded by a flowable liquid. A passage 32 is defined through the light-transmittable aqua-lamp base 3 in communication with the chamber 31 at a location corresponding to the open end 11 of the stand 1. If desired, the flowable liquid may be mixed with flake- or particle-like spangles. The aqua-lamp, as a whole, is mounted to the open end 11 of the stand 1 in such a way that the bottom of the aqua-lamp base corresponds to and is spaced from the incandescent lamp assembly 2 by a given distance.

An illuminator 4 is mounted at an open end 311 of the internal chamber 31 of the aqua-lamp base 3 and is electrically connected to a power source by means of an electrical wire 200 through the passage 32 via the incandescent lamp assembly 2 to generate twinkling lighting.

Figure 2:
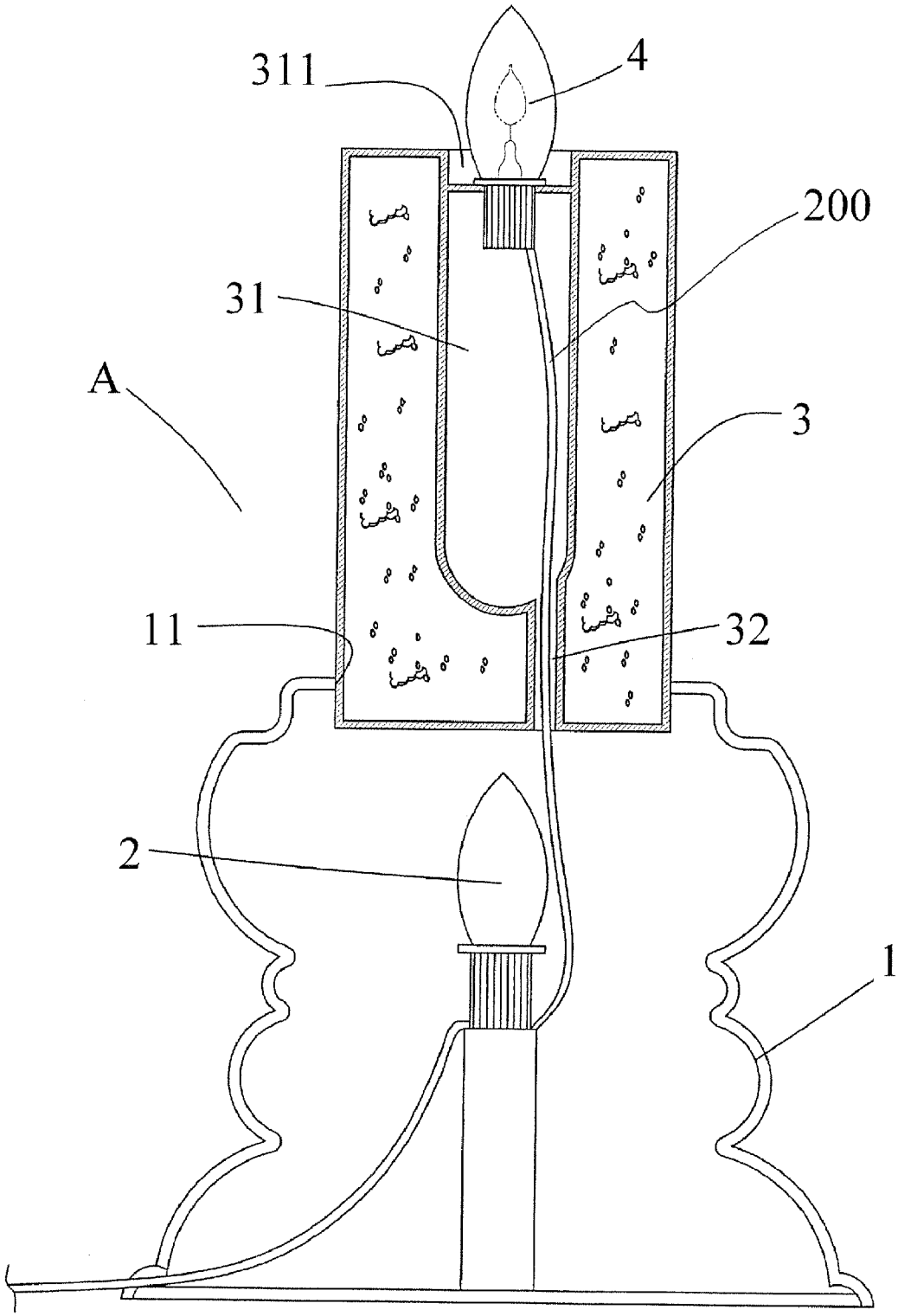
FIG. 2 is a cross-sectional view of the aqua-lamp-based candle-like lighting device of the present invention.
Figure 3:
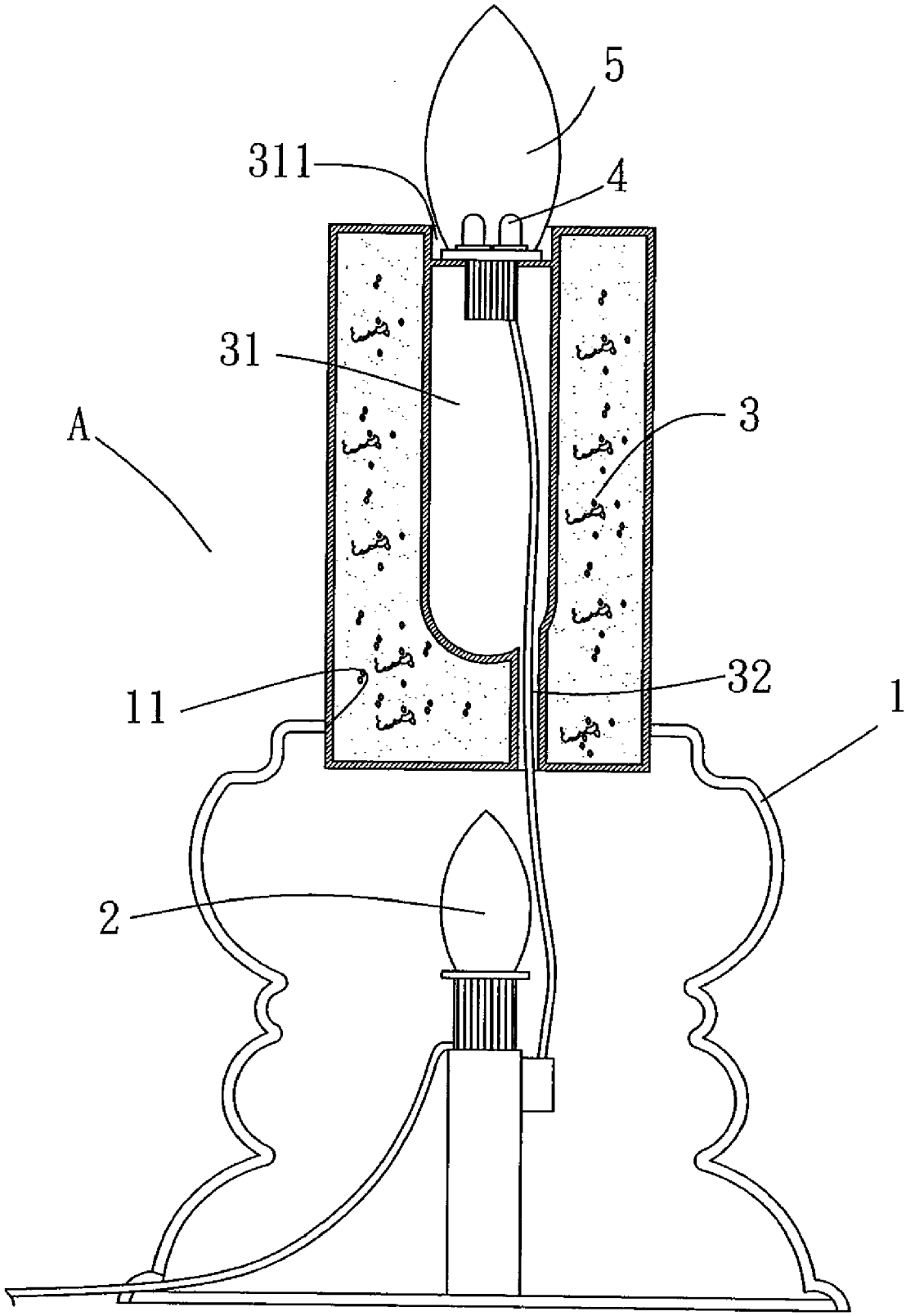
FIG. 3 is a cross-sectional view of the aqua-lamp-based candle-like lighting device in accordance with a modified embodiment of the present invention.

Also referring to FIG. 2, which shows a cross-sectional view of the aqua-lamp-based candle-like lighting device in accordance with the present invention, the aqua-lamp-based candle-like lighting device A of the present invention is formed by first electrically connecting the incandescent lamp assembly 2 inside the stand 1 to a power source to have the incandescent lamp assembly 2 energized for generating light and heat. In the time when the incandescent lamp assembly 2 generates heat, the heat is transferred to the bottom of the aqua-lamp base 3, leading to a rise of temperature that makes the liquid flowing inside the aqua-lamp base due to heat convection and at the same causing the spangles to move with the liquid flow so that shining and interesting aqua lamp is realized. Further, when the incandescent lamp assembly 2 is conducted on with the power source, the illuminator 4 is also energized to give off twinkling light, so that the illuminator 4 generates twinkling lighting at the open end 311 of the internal chamber 31 similar to candle lighting. An inside surface of the chamber 31 is preferably coated with a colored layer to shield electrical wire or cable. The illuminator 4 can be for example a regular lamp bulb or a light-emitting diode, or alternately, the illuminator 4 is a twinkling bulb, which provides lighting/darkening-alternating lighting effect. Also referring to FIG. 3, a flame-like shade 5 is mounted to the aqua-lamp base 3 at a location corresponding to the light-emitting diode of the illuminator 4. Fitting the shade 5 outside the light-emitting diode mimics a flaming candle, and the lighting provided by the light-emitting diode make the whole lighting device more beautiful and attractive.

From the above description of the constituent parts and operation of the aqua-lamp-based candle-like lighting device of the present invention, several advantages can be recognized and will be briefed as follows:

(1) The aqua-lamp-based candle-like lighting device of the present invention comprises a stand that receives and fixes therein an incandescent lamp assembly for generating heat that causes flow of liquid inside an aqua-lamp base to show shining and interesting candle lighting.

(2) The aqua-lamp-based candle-like lighting device of the present invention comprises an illuminator arranged in the light-transmittable aqua-lamp base to provide a visual effect of twinkling lighting in the nighttime.

(3) Based on the above two points, the stand of the aqua-lamp-based candle-like lighting device of the present invention is provided with the incandescent lamp assembly to generate heat for inducing liquid flow inside the aqua-lamp base and also comprises the illuminator arranged in the light-transmittable aqua-lamp base to provide dual interests of visual effects in light twinkling and liquid flowing.

(4) The aqua-lamp-based candle-like lighting device of the present invention comprises a flame-like shade fit over the light-emitting diode of the illuminator, which mimics a flaming candle, so that the aqua-lamp-based candle-like lighting device of the present invention as a whole is more similar to the aesthetic visual effect that a candle can provide.

To conclude, the above description of the integral formation of the structure in accordance with the embodiment of the present invention reveals that the present invention does perfectly exhibit the functionality of the aqua-lamp-based candle-like lighting device and that, based on co-existence of the illuminator and the heat source, the present invention provides dual interprets of visual effects in light twinkling and liquid flowing.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An aqua-lamp-based candle-like lighting device comprising:

a hollow stand having an open top and an open bottom;

an incandescent lamp assembly having a lighting element mounted on a bottom cover engaged with said open bottom of said hollow stand;

a cylindrical light-transmittable aqua-lamp base provided with an internal chamber which is circumferentially surrounded by a flowable liquid, said cylindrical light-transmittable aqua-lamp base having a passage which extends through said cylindrical light-transmittable aqua-lamp base in communication with said internal chamber and set at a location corresponding to said open top of said hollow stand for passage of an electrical wire, said cylindrical light-transmittable aqua-lamp base being mounted on said open top of said hollow stand in such a way that a bottom of said cylindrical light-transmittable aqua-lamp base corresponds to and is spaced from said incandescent lamp assembly by a given distance;

a twinkling bulb mounted on a top of said internal chamber and electrically connected with said incandescent lamp assembly via said electrical wire through said passage;

said internal chamber having an inner surface coated with a colored layer to shield said electrical wire; and a flame-like shade mounted on said twinkling bulb;

wherein when said lighting element of said incandescent lamp assembly is turned on, said lighting element will generate heat which is in turn transferred to a bottom of said cylindrical light-transmittable aqua-lamp base thereby leading a rise of temperature that makes said flowable liquid flowing inside said cylindrical light-transmittable aqua-lamp base due to heat convection and causing said spangles to move with said liquid, and said twinkling bulb will be turned on to give off twinkling light.

2. The aqua-lamp-based candle-like lighting device as claimed in claim 1, wherein said flowable liquid contains flake-like spangles.

* * * * *